US005964939A

United States Patent [19]

Fox et al.

[11] Patent Number: 5,964,939

[45] Date of Patent: Oct. 12, 1999

[54] DYE TRANSFER INHIBITING FABRIC SOFTENER COMPOSITIONS

[75] Inventors: Daniel Joseph Fox, Tenafly; Nancy Pergament, Closter; Feng-Lung Hsu, Tenafly, all of N.J.

[73] Assignee: Lever Brothers Company, Division of Conopco, Inc., New York, N.Y.

[21] Appl. No.: 08/887,589

[22] Filed: Jul. 3, 1997

[51] Int. Cl.[6] ..... D06M 13/00; D06L 3/12

[52] U.S. Cl. ..... 106/516; 106/515; 106/521; 106/522; 106/527; 8/137

[58] Field of Search ..... 510/515, 516, 510/521, 522, 527; 8/137

[56] References Cited

U.S. PATENT DOCUMENTS

| | | | |
|---|---|---|---|
| 4,562,002 | 12/1985 | Neiditch et al. | 510/516 |
| 4,772,404 | 9/1988 | Fox et al. | 510/516 |
| 4,822,499 | 4/1989 | Wahl et al. | 510/522 |
| 4,844,820 | 7/1989 | Piper et al. | 510/523 |
| 4,954,292 | 9/1990 | Hull et al. | 510/350 |
| 5,089,148 | 2/1992 | Van Blarcom et al. | 510/522 |
| 5,130,035 | 7/1992 | Dell'Arno | 510/522 |
| 5,183,580 | 2/1993 | Lew et al. | 510/522 |
| 5,259,994 | 11/1993 | Welch et al. | 510/348 |
| 5,288,417 | 2/1994 | Bauer et al. | 510/522 |
| 5,411,671 | 5/1995 | Bauer et al. | 510/522 |
| 5,445,747 | 8/1995 | Kvietok et al. | 510/101 |
| 5,458,809 | 10/1995 | Fredj et al. | 510/276 |
| 5,466,802 | 11/1995 | Panandiker et al. | 544/193.2 |
| 5,534,182 | 7/1996 | Kirk et al. | 8/137 |
| 5,599,786 | 2/1997 | Siklosi et al. | 510/522 |
| 5,686,376 | 11/1997 | Rusche et al. | 502/329 |
| 5,721,205 | 2/1998 | Barnabas et al. | 510/522 |
| 5,767,062 | 6/1998 | Trinh et al. | 510/516 |

FOREIGN PATENT DOCUMENTS

| | | |
|---|---|---|
| 0508358 | 10/1992 | European Pat. Off. . |
| 0668902 | 3/1997 | European Pat. Off. . |
| 95/05442 | 2/1995 | WIPO . |

*Primary Examiner*—Anthony Green
*Attorney, Agent, or Firm*—Neil Y. Gilbert, Esq.

[57] ABSTRACT

A concentrated aqueous fabric conditioning composition which both conditions and inhibits dye transfer is described. The composition includes a fabric conditioning active and a dye transfer inhibiting compound preferably polyvinyl pyrrolidone and a colorant. Methods of preparing and using the compositions are also described.

18 Claims, No Drawings

DYE TRANSFER INHIBITING FABRIC SOFTENER COMPOSITIONS

FIELD OF THE INVENTION

This invention relates to fabric conditioning compositions intended for use in the rinse cycle containing a softening active and a dye transfer inhibiting compound.

BACKGROUND OF THE INVENTION

Liquid rinse cycle fabric conditioners have been used for many years to provide a softened feel to garments that have become harsh during the washing process. Most commercially available fabric conditioners use tallow based cationic actives, optionally in combination with nonionic actives, to deposit onto the garments to provide a soft tactile feel. In addition, fabric conditioners are well known to provide substantial fragrance benefits thus increasing their overall appeal to consumers.

Well known methods of providing both softening and fragrance benefits are described in the art. However, as consumer use habits and needs have changed over the years, the need to provide benefits in the areas of color care and fabric care have increased substantially. One highly desirable aspect of color care is the prevention of vagrant dyestuffs transferring from one garment to another during the course of the washing process. Various compositions which provide this benefit during the wash cycle are described in the prior art and available commercially in laundry detergent products. U.S. Pat. No. 5,458,809 (Fredj et al.) describes the use of a specific polymer type, PVP-N-Oxide, for use as a dye transfer inhibitor in the wash cycle. It is provided in a detergent mixture that contains anionic and nonionic surfactants and can include the use of mono long chain cationic surfactants. U.S. Pat. No. 4,954,292 (Hull et al.) describes the use of polyvinyl pyrrolidone to prevent redeposition of soils or dyestuffs when used in a laundry detergent in combination with an anionic surfactant and a specific nonionic with an HLB of 10.5 or less. U.S. Pat. No. 5,259,994 (Welch et al.) describes the use of polyvinyl pyrrolidone (PVP) in a particulate laundry detergent. The PVP is used in combination with hydrating salts and binding agents to form a separate particle which is then added to the remainder of the detergent which contains anionic and/or nonionic surfactants. EP 0508358A1 (Busch et al.) describes the use of cellulase enzymes and PVP in combination in a laundry detergent. The detergent may include anionic and nonionic surfactants and may optionally include mono long chain cationics. None of these cited publications specify the use of a dye transfer inhibitor in a rinse cycle product combined with the use of cationic surfactants to provide fabric softening benefits.

WO 95/05442 (Siklosi et al) describe the use of a specific molecule, PVP-N-Oxide, for use in a rinse conditioner application as an optional component that stabilizes cellulase enzymes. While this reference does cite the use of long chain cationic actives, it requires the presence of cellulase enzymes since the PVP-N-Oxide is utilized as an enzyme stabilizer.

U.S. Pat. No. 5,534,182 (Kirk et al) describes the use of dye transfer inhibitors in either the wash or rinse cycle of the laundry process. Dye transfer inhibitors cited include polyethoxylated urethane, acylamide polymer and certain poly (amino)acids. It fails to show the use of the specific dye transfer inhibitors cited in this application, nor does it mention the benefits of using any of the selected colorants described herein.

EP 0668902 B1 (Trinh et al) describes the use of dye transfer inhibitors such as PVP among others that are suitable for use in a liquid or sheet fabric softener. While it includes an extensive list of dye transfer inhibitors useful as rinse cycle products, and it states that dyes can be used in its compositions, Trinh et al fails to describe those dyestuffs cited in the present application which allow for successful use of the dye transfer inhibitors without incurring problems of staining or loss of color intensity.

U.S. Pat. No. 4,822,499 (Wahl et al) cites specific dyestuffs for use in rinse conditioners that provide a pink color and are light stable.

U.S. Pat. No. 4,844,820 (Piper) cites other specific dyestuffs for use in rinse conditioners that provide a pink color at low product pH (below 4).

U.S. Pat. No. 5,183,580 (Lew et al) cite specific dyestuffs for use in rinse conditioners that provide a green color.

U.S. Pat. No. 5,130,035 (Dell'Armo et al) describes specific dyestuffs for use in rinse conditioners that use red colorant to provide a stable pink product color.

U.S. Pat. No. 5,089,148 (van Blarcom et al) describes specific colorants for use in rinse conditioners that combine yellow and red colorant to provide a stable peach product color.

While the above mentioned patents cite some of the colorants for use in rinse conditioners that are included in the compositions of this invention, none of them cite the use of dye transfer inhibitors.

All of the cited publications fail to suggest the use of a dye transfer inhibitor such as PVP in combination with long chain cationic surfactants and specific colorants compatible with the dye transfer inhibitor for use in providing softening and other benefits in the rinse cycle without incurring increased potential for fabric staining. In part this results from the assumption that dye transfer inhibitors such as PVP are not able to provide additional benefits in this area to those already provided to some degree by the long chain cationic molecules themselves which are known to complex with some classes of anionic dyestuffs. It is the surprising finding that additional benefits in dye transfer inhibition are provided by the use of dye transfer inhibitors such as PVP when used in combination with long chain cationic surfactants and certain specified colorants in the rinse cycle, that provides a basis for our invention. This synergistic increase in dye transfer benefits during the rinse cycle when combined with the delivery of softening benefits from the long chain cationic surfactants and with no increase in fabric staining allows our invention to address two consumer valued needs that have to date been unavailable in a rinse cycle product. It is a further advantage that these benefits can be provided from a colored product that has a consumer pleasing appearance without having to incur an increased potential for fabric staining in use in the rinse cycle.

SUMMARY OF THE INVENTION

It is therefore an object of this invention to provide the benefits of fabric softening along with that of color care through the use of dye transfer inhibition in a convenient single product form. It is a further object of this invention to provide these benefits in the rinse cycle where the delivery of the benefits is unencumbered by the requirements of the cleaning agents present in a laundry detergent product. An additional object of this invention is to deliver these benefits from a rinse conditioner that is in a highly concentrated form to allow the product to be commercialized in a form that minimizes the use of disposable packaging materials. A synergistic increase in dye transfer benefits during the rinse cycle occurs through combined use of the cationic fabric softener and the dye transfer inhibitor. When combined with the delivery of softening benefits from the long chain cationic surfactants and with no increase in fabric staining, our invention addresses two consumer valued needs that have to date been unavailable in a rinse cycle product. Yet a further objective of the invention is to provide these benefits with a colored product that has consumer pleasing appearance without having to incur an increased potential for fabric staining in use in the rinse cycle.

The present invention relates to a colored concentrated fabric softening composition intended for use in the rinse cycle that provides both garment softening and dye transfer inhibition benefits. The composition comprises by weight the following ingredients:

a) from about 3% to about 35% by weight of a fabric conditioning agent selected from the group consisting of cationic softening actives, nonionic softening actives or mixtures of actives, and b) a colorant selected from the group of dyestuffs and pigments that exhibit a low degree of fabric staining when used in a rinse cycle product at levels from about 1 ppm to about 500 ppm to provide a consumer pleasing appearance and c) from about 0.1% to about 10% of a dye transfer inhibiting compound, preferably polyvinyl pyrrolidone with a molecular weight of from about 1,000 to about 100,000.

The present invention further relates to a method for softening fabrics with use of a colored fabric softener while additionally providing dye transfer inhibition benefits when used as provided above upon addition to the rinse cycle of the washing process. An inventive process for adding the dye transfer inhibitor to a mixture of the softening actives to provide optimal stability for the resultant composition is also described.

DETAILED DESCRIPTION OF PREFERRED EMBODIMENTS

Unless otherwise indicated, %, as used herein means % by weight. Unless otherwise indicated the terms fabric conditioner and fabric softener are used interchangeably.

The present invention pertains to a colored concentrated aqueous fabric conditioner composition comprising water, colorants, fabric conditioning active and a dye transfer inhibiting agent that provides both garment softening and dye transfer inhibition benefits. The composition comprises by weight:

a) from about 3% to about 35% by weight of a fabric conditioning agent selected from the group consisting of a cationic softening active, a nonionic softening active or a mixture thereof, b) from about 0.0001% (1 ppm) to about 0.05% (500 ppm) by weight of a colorant selected from the group of dyestuffs and pigments that exhibit a low degree of fabric staining when used in a rinse cycle product. Included in this grouping are dyestuffs such as Acid Blue 80, FD&C Blue 1, Acid Yellow 17, Acid Yellow 23, FD&C Green 3, FD&C Red #4, Acid Red #52 and mixtures of the above, and, c) from about 0.1% to about 10% of a dye transfer inhibiting compound with a preferred compound being polyvinyl pyrrolidone with a molecular weight of from about 1,000 to about 100,000.

Cationic Softeners Actives

The cationic softeners used in the present compositions can be any of those substantially water-insoluble cationic active materials generally recognized in the art for their fabric softening properties. Typical examples include:

A. Mono nitrogen quaternary ammonium cationic salts having the structure

I

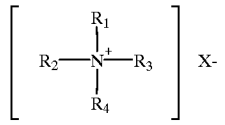

wherein $R_1$ is selected from $C_1$ to $C_{20}$ alkyl and alkenyl groups, and $R_2$ is selected from the group consisting of $C_{14}$ to $C_{20}$ alkyl and alkenyl groups and $R_3$ and $R_4$ are the same or different from each other and are selected from the group consisting of $C_1$ to $C_3$ alkyls, or $—(C_nH_{2n}O)_xH$ wherein n is 2 or 3, x is from 1 to about 3, and wherein X— is halide, $HSO_4$—, nitrate, methyl sulfate or ethylsulfate. It is preferred that X— be methyl sulfate or halide, and the preferred halides are chloride and bromide. Preferably the $R_1$ and $R_2$ groups are $C_{14-20}$ alkyl and alkenyl groups, most preferably derived from tallow, and the $R_3$ and $R_4$ groups are methyl. The tallow can be hydrogenated or unhydrogenated. Hydrogenated tallow is preferred, and halides or methyl sulfates are the preferred anions. A highly preferred mono nitrogen quaternary ammonium salt softener compound herein is dihydrogenated tallow dimethyl ammonium chloride. Commercial available supplies of this compound are Adogen 442 ex Witco or Arquad 2HT ex Akzo.

B. Imidazolinium salts of formula II are as follows:

II

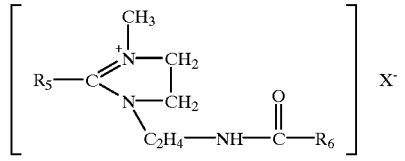

wherein $R_5$ and $R_6$ are the same or different from each other and are selected from the group consisting of $C_{14}$ to $C_{20}$ alkyl and alkenyl groups, wherein X— is as defined above.

C. Di(2-aminoethyl)methyl quaternary ammonium salts have the structure:

III

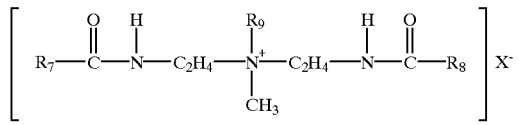

wherein $R_7$ and $R_8$ are the same or different from each other and are selected from the group consisting of $C_{14}$ to $C_{20}$ alkyl and alkenyl groups, wherein $R_9$ is selected from H, methyl, ethyl and $—(C_nH_{2n}O)_xH$ wherein n is 2 or 3 and x is from 1 to about 5 (preferably 2.5), and wherein X— is as defined above. Preferably $R_7$ and $R_8$ are alkyl and $R_9$ is $—(C_nH_{2n}O)_xH$. This class of compounds is disclosed in U.S. Pat. No. 4,134,840, Minegishi et al., issued Jan. 17, 1979, incorporated herein by reference. Commercial examples of this product are available as Accosoft 460HC ex Stepan or Varisoft 222 ex Witco.

D. Biodegradable Ester Quaternary Ammonium Compounds have the following formula:

IV

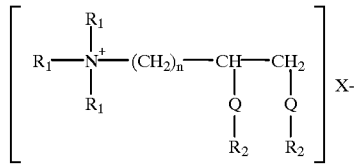

or

V wherein each Q is —O—(O)C— or —C(O)—O; m=1 to 3; each n=an integer from 1 to 4, and mixtures thereof;

each $R_1$ substituent is a short chain $C_1$–$C_6$, preferably $C_1$–$C_3$, alkyl group, e.g., methyl, ethyl, propyl, and the like; a short chain $C_1$–$C_4$ hydroxy alkyl group; benzyl; or mixtures thereof;

each $R_2$ is a long chain, saturated and/or unsaturated $C_8$–$C_{30}$ hydrocarbyl, or substituted hydrocarbyl substituent, preferably straight or branched alkyl or alkenyl chain, preferably containing from about 14 to about 18 carbon atoms, more preferably straight chain, or mixtures thereof; and the counterion, $X^-$, can be any softener-compatible anion, for example, chloride, bromide, methylsulfate, ethylsulfate and the like.

Examples of structure V include diethyl ester dimethyl ammonium chloride commercially available through Hoechst Co. and methyl hydroxy ethyl diethyl ester ammonium methyl sulfate from Stepan Chemical and sold commercially as Stepantex.

Tallow is a convenient and inexpensive source of long chain alkyl and alkenyl materials.

Colorants

The colorants for use in the fabric softeners described in this application can be any dyestuff or pigment that exhibits the surprising property of low fabric staining levels when used in a fabric softener application in which a water soluble dye transfer inhibitor is included. Among the specific colorants that are included within the scope of this application are those direct and acid dyes which are commonly used in fabric softeners to provide the products with consumer preferred colors. It is especially surprising that these colorants are among those usable in this area since they are also among the dyestuffs most strongly attracted to the dye transfer inhibitors included within the compositions of this invention and as such would be expected to provide a product color that was less appealing to consumers and to have a strong staining potential.

The colorants in this invention may be used in the range of from about 1 ppm to about 500 ppm, preferably from about 2 ppm to about 200 ppm and may be used either individually or as mixtures of two or more colorants. Colorants useful in this invention include those direct dyes and acid dyes included in the Color Index, Volumes 1 & 2, published by the Society of Dyers and Colorists, Yorkshire England and the American Association of Textile Chemists and Colorists, Research Park, N.C. Specific examples of colors include the following: Acid Blue 80 (Cl 61585), FD&C Blue 1 (Cl 42090), Acid Yellow 17 (Cl 18965), Acid Yellow 23 Cl 19140), FD&C Green 3 (Cl 42053), FD&C Red 4 (Cl 14700) and Acid Red 52 Cl 45100).

It should be understood that the specific examples of dyes shown do not limit the fields of dyestuffs considered within the scope of this invention and also that equivalent dyes that are not certified but that correspond chemically to the certified dyes listed are also included in the scope of this invention.

Dye Transfer Inhibiting Compounds

Dye transfer inhibiting compounds are an essential ingredient of the present invention. A highly preferred dye transfer inhibiting compound is polyvinyl pyrrolidone. As described in the art, PVP is not a single individual compound but is obtained as a mixture of various degrees of polymerization. The degree of polymerization is most easily expressed in terms of an average molecular weight, with an average molecular weight of from about 1,000 to 100,000 providing the desired water solubility and dye transfer inhibiting properties. Substituted and unsubstituted vinyl pyrrolidone products are included herein. Preferred compounds have average molecular weights from about 5,000 to about 50,000 and are used at levels from about 0.1% to about 10% and more preferably from about 0.25% to about 5%. Commercial examples of suitable materials include PVP-K15 from ISP Inc. and Sokolan HP-53 from BASF Inc.

Other dye transfer inhibiting compounds that are included in this invention are polymers of vinylimidazole with a molecular weight of about 5,000 to about 50,000 or copolymers of N-vinylimidazole and N-vinylpyrrolidone having average molecular weights of between about 5,000 to about 50,000 and that are used at levels from about 0.1% to about 10%.

Additional polymeric dye transfer inhibitors included with the scope of this invention are the polyamide N-oxide polymers as described in U.S. Pat. Nos. 5,466,802 and 5,458,809 both of which are hereby incorporated by reference. Particularly preferred among these polymers is poly (4-vinylpyrridine-N-oxide) with molecular weight from about 10,000 to about 100,000 and used at levels from about 0.1 to about 5%. Other additional compounds that provide the dye transfer inhibiting properties that are described in this invention and are compatible with the cationic and/or nonionic actives that provide softening benefits are included within the scope of this invention. The dyestuffs included in the compositions of this invention provide a low degree of staining when used in combination with the dye transfer inhibitors.

Optional Ingredients

Sometimes it is desirable to use acidic components such as low levels of mineral acids or weak organic acids to adjust pH levels to between 2 to 6. Although such pH adjustment is not mandatory, it has been found beneficial in reducing bacterial contamination of the final products. Accordingly, acids such as citric acid, lactic acid or other weak organic acids are often used for a pH adjustment. Inorganic acids such as sulfuric acid may also be used. Typically, these materials are used at a level of between 0.01% and 0.5% when a pH of 2.0 to 6.0 is desired.

Other Optional Ingredients

In order to further improve the stability of the compositions herein, and further adjust their viscosities, these compositions can contain relatively small amounts of inorganic viscosity control agents. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. A highly preferred electrolyte is $CaCl_2$. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

The compositions herein can optionally contain other ingredients known to be suitable for use in textile softeners. Such adjuvants include perfumes, preservatives, enzymes, such as cellulase, lipases, silicones, germicides, fungicides, stabilizers, anti-wrinkle agents, soil release agents, fabric crisping agents, UV absorbers and anti-oxidants, opacifiers and the like. All flourescent whiteners compatible with the combination of fabric softener actives, colorants and dye transfer inhibitors may be included in the compositions of the present invention. Preferred whiteners include those derived from stilbene sulfonic acid (often referred to as DAS/CCTYPES)as described in detail in U.S. Pat. No. 4,772,404 incorporated herein by reference. In a preferred composition, the fluorescent whiteners would be accompanied with use of a non-ionizing base such as triethanolamine to insure its physical stability in the product. They would be used in ratios and at levels described in U.S. Pat. No. 4,562,002 which is hereby incorporated by reference. These adjuvants, if used, are normally added at their conventional levels. However, in the case of composition ingredients utilized for a fabric treatment effect, e.g., perfumes, these materials can be added at higher than normal levels, corresponding to the degree of concentration of the product.

Process

The formulations of the invention can be prepared by either a continuous process or a batch process. The process allows concentrated compositions to be made on a commercial scale. The continuous process avoids the need to mix large quantities of highly viscous gels as would be encountered in a batch process and has the advantage that less energy is consumed than in an equivalent batch process.

The continuous mixer comprises a 4 inch diameter pipeline, for example, equipped with a series of in-line mixers. Addition of the components of the composition is achieved via ports located immediately upstream of a mixer at various points along the pipeline. The dye transfer inhibiting agent can be added either as a solid or preferably prediluted as a solution in water. The dye transfer inhibiting agent is added to the rest of the composition by post dosed to the solution of water and active. Dynamic mixers are used to mix the active and water and may be of Gifford-Wood type equipped with a turbine capable of peripheral velocities of from 0 to 100 feet per second. Alternative dynamic mixers to the Gifford-Wood type are Ika, Ross and Dicon.

A preferred embodiment of the continuous process is as follows. The cationic fabric conditioning agent is heated until molten and mixed in an in-line dynamic mixer with a premix of deionized water, preservative and dye to form a homogeneous dispersion of the active in water as described in U.S. Pat. Nos. 5,288,417 and 5,411,671 which are both herein incorporated by reference. A solution of calcium chloride in water (2.5–10%) is dosed and mixed under controlled shear into the dispersion in a series of distinct sequential additions. The stream of fabric conditioning composition is then cooled in-line and again dosed with calcium chloride. The dye transfer inhibitor is then added as a liquid solution to the fabric conditioning composition and is thoroughly dispersed in the mixture. Optionally further cooling takes place by collecting the product in an agitator vessel and recirculating the product through a heat exchanger. Calcium chloride is dosed again to adjust the viscosity and perfume is added and mixed in a relay tank. By use of this process fabric conditioning compositions can be manufactured at a rate of up to 200 gallons per minute, more typically 50 to 150 gallons per minute.

The formulations of the invention can also be prepared by a batch process. The fabric softening ingredients are co-melted in step (a) at a temperature above the melting point of the active having the highest melting point, to form a premixture. Various additives may also be included in the compositions. These include small amounts of incompatible and compatible silicones such as predominantly linear dialkylsiloxanes, e.g. polydimethylsiloxanes; polyalkyldimethylsiloxane, and polyalkyl amino dimethyl siloxane and mixtures thereof; quaternary ammonium salts having at least one $C_{8-30}$ alkyl chain; soil release polymers such as block copolymers of polyethylene oxide and terephthalates; fatty amines selected from the group consisting of primary fatty amines, secondary fatty amines, tertiary fatty amines and mixtures thereof; amphoteric surfactants; smectite type inorganic clays; zwitterionic quaternary ammonium compounds; and nonionic surfactants.

In step (b) a solution of an acid in water is prepared at a temperature of from 50° to 100° C. Bronstedt acids having a pKa value of 4 or less have been found suitable. Examples include inorganic mineral acids, e.g., HCl, HBr, $H_2SO_4$, $HNO_3$ and $H_3PO_4$ and organic acids e.g., lactic, citric, formic and methylsulfonic acid.

The acid is added to the water to obtain a final formulation pH of less than 4.5, preferably 2 to 4.5, most preferably 3 to 4. The entire quantity of acid is added into the water to obtain the desired pH. If the pH level is below 2, it may be adjusted at the end of the process to a level above pH 2. The premixture of fabric agents is mixed into the acid solution with agitation and at a temperature at or slightly below the temperature of the melting point of the premixture formed in step (a). Preferably, the heat source is turned off while mixing continues at a speed to create a vortex, but not at a high mixing speed. Preferably, the speed is set at about 1 to 3 m/seconds.

The selected speed range is preferable to obtain average particle diameter of the dispersion of about 2 to about 8 microns. These relatively large particle sizes are preferred to obtain a stable product according to the inventive process. Particles having diameter sizes averaging less than 1 micron are deleterious to product stability.

A solution of inorganic salt is then added to the mixing composition in small aliquots, preferably a 10% salt solution is added in aliquots of less than 0.05 wt % of the total amount of the composition. As the formulation thins, the speed is decreased further and the salt solution may be added in larger aliquots. The product is continuously mixed as it cools to a temperature slightly above a differential scanning calorimeter transition temperature, preferably about 90° F. to 130° F. During cooling, more electrolyte may be added to bring the viscosity of the formulation to a desired range of between 50 and 500 centipoise as measured by a Brookfield viscometer using Spindle #1 at 12 rpm.

The dye transfer agent is then added as required and mixed into the product until thoroughly dispersed. The colorants can be added either as solids or as a dispersion in water and can be added either before or after the active addition as long as they are thoroughly dispersed into the system.

Any other optional ingredients may be added to the mixture as it cools. Such optional ingredients include enzymes, such as cellulase or lipase enzymes, silicone emulsions, hydrocarbon oil emulsions, preservatives, optical brighteners, buffers, opacifiers, germicides and bactericides. The amount of each optional additive is up to about 2.0% by weight.

Method of Use

The present invention also relates to a method for inhibiting dye transfer from one fabric to another of solubilized and suspended dyes encountered during fabric rinsing operations involving colored fabrics. In the method aspect of this invention, fabrics or fibers are contacted with an effective amount, generally from about 10 ml to about 150 ml of the dye transfer inhibiting softener composition herein in an aqueous rinse bath. Of course, the amount used is based upon the judgment of the user, depending on concentration of the composition, fiber or fabric type, size of the load being laundered. Preferably, the rinse bath contains from about 10 to about 1,000 ppm, more preferably from about 50 to about 500 ppm, and even more preferably from about 50 to about 150 ppm, of total active fabric softening compounds herein.

The following examples illustrate the present invention and are not meant to be limiting:

Unless otherwise indicated, the amounts in the examples below are in weight per cent.

EXAMPLES 1–4

The following examples show the use of different molecular weights and use levels of polyvinylpyrrolidone as a dye transfer inhibitor in a composition of the invention.

| Ingredient | EX. 1 | EX. 2 | EX. 3 | EX. 4 |
|---|---|---|---|---|
| Accosoft 460 HC[1] | 17.7 | 17.7 | 17.7 | 17.7 |
| Adogen 442[2] | 6.5 | 6.5 | 6.5 | 6.5 |
| PVP K-15[3] | 0.75 | 0 | 0 | 0 |
| Sokolon HP-53[4] | 0 | 0.25 | 1.0 | 0 |
| Lactic Acid | 0.225 | 0.225 | 0.225 | 0.225 |
| Calcium Chloride | 0.25 | 0.25 | 0.25 | 0.25 |
| Ucarcide 250[5] | 0.07 | 0.07 | 0.07 | 0.07 |
| Perfume | 0.68 | 0.68 | 0.68 | 0.68 |
| Acid Blue 80 Dye (CI 61585) | 0.0045 | 0.0045 | 0.0045 | 0.0045 |
| Misc. and deionized water | to 100% | to 100% | to 100% | to 100% |

[1]Accosoft 406HC is supplied by Stepan Company of Northfield, Ill. and is Di(2-tallow/Hydrogenated Tallow Amidoethyl) ethoxylated methyl ammonium methylsulfate.
[2]Adogen 442 is supplied by Witco Corp. and is dihydrogenated tallow dimethylammonium chloride.
[3]PVP K-15 is supplied by ISP and is polyvinyl pyrrolidone with a MW of 10,000.
[4]Sokolon HP-53 is supplied by BASF and is polyvinyl pyrrolidone with a MW of 40,000.
[5]Ucarcide 250 is glutaraldehyde supplied by Union Carbide.

Example 4 does not contain a dye transfer inhibitor and is outside the scope of this invention. It is included for comparison purposes.

EXAMPLES 5–8

The following examples show use of preferred colorants and fluorescent whitening agents that are used along with dye transfer inhibitors.

| Ingredient | EX. 5 | EX. 6 | EX. 7 | EX. 8 |
|---|---|---|---|---|
| Accosoft 460 HC | 17.7 | 17.7 | 17.7 | 17.7 |
| Adogen 442 | 6.5 | 6.5 | 6.5 | 6.5 |
| PVP K-15 | 0.75 | 0.75 | 0.75 | 0.75 |
| Lactic Acid | 0.225 | 0.225 | 0.225 | 0.225 |
| Calcium Chloride | 0.25 | 0.25 | 0.25 | 0.25 |
| Ucarcide 250 | 0.07 | 0.07 | 0.07 | 0.07 |
| Perfume | 0.61 | 0.80 | 0.80 | 0.7 |

-continued

| Ingredient | EX. 5 | EX. 6 | EX. 7 | EX. 8 |
|---|---|---|---|---|
| Acid Blue 80 Dye (CI 61585) | 0 | 0 | 0 | 0.0045 |
| Acid Yellow 17 (CI 8965) | 0.003 | 0.00164 | 0.005 | 0 |
| FD&C Green No. 3 (CI 42053) | 0 | 0.00044 | 0 | 0 |
| Acid Red No. 52 (CI 45100) | 0 | 0 | 0.0004 | 0 |
| Tinopal UNPA[6] | 0 | 0 | 0 | 0.15 |
| Triethanolamine | 0 | 0 | 0 | 0.10 |
| Misc. and deionized water | to 100% | to 100% | to 100% | to 100% |

[6]Dihydroxyethylamine stilbene sulfonic acid fluorescent whitener ex Ciba Geigy.

EXAMPLES 9–13

The following examples illustrate the use of different active systems and different dye transfer inhibitors when combined with preferred colorants.

| Ingredient | EX. 9 | EX. 10 | EX. 11 | EX. 12 | EX. 13 |
|---|---|---|---|---|---|
| Accosoft 460 HC | 17.7 | 0 | 0 | 0 | 17.7 |
| Adogen 442 | 6.5 | 3.5 | 0 | 0 | 6.5 |
| Diethyl Ester Dimethyl Ammonium Chloride[7] | 0 | 0 | 20.0 | 0 | 0 |
| Methyl, Hydroxyethyl Diethyl Ester Ammonium Methyl Sulfate[8] | 0 | 0 | 0 | 25.0 | 0 |
| PVP K-15 | 0 | 0.30 | 0.75 | 0.75 | 0 |
| Lactic Acid | 0.225 | 0.015 | 0.05 | 0.05 | .225 |
| Calcium Chloride | 0.25 | 0.005 | 0.7 | 0.1 | .25 |
| Ucarcide 250 | 0.07 | 0.07 | 0.07 | 0.07 | 0.07 |
| Perfume | 0.7 | 0.28 | 0.7 | 0.7 | 0.7 |
| Acid Blue 80 Dye (C161585) | .0045 | .002 | .0045 | .0045 | .0045 |
| PVP/PVI[9] | 0.50 | 0 | 0 | 0 | 0 |
| PVI[10] | 0 | 0 | 0 | 0 | 0.75 |
| Misc. and deionized water | to 100% | to 100% | to 100% | to 100% | to 100% |

[7]DEEDMAC with IV (iodine value) equal to 5 supplied by Hoechst Chemical Co.
[8]Stepantex with IV equal to 40 is supplied by Stepan Chemical.
[9]A copolymer of polyvinylpyrrolidine and polyvinylimidazole supplied by BASF.
[10]Polyvinylimidazole polymers supplied by BASF.

Methods of Preparation

The examples shown above can be prepared by co-melting the Accosoft 460HC and Adogen 442 at a temperature of 160° F. The lactic acid was added to the deionized water and preservative and heated to a temperature of 160° F. The dye transfer inhibiting agent can be added either as a solid or preferably prediluted as a solution in water. The dye transfer inhibiting agent is added to the rest of the composition by post dosed to the solution of water and active. The co-melted premixture was added with stirring at 1 m/second to form a homogeneous mixture at a temperature of 160° F. The mixing speed was increased to 3.5 m/seconds to create a vortex and solutions of calcium chloride were added in aliquots of about 0.05% to thin the mixing product. When the product cooled to a temperature of 120° F., calcium chloride was added to obtain initial viscosities between about 40 and 70 centipoise. The colorants are added to the initial water, preservative and lactic acid prior to heating but can be added either before or after the addition of the actives or dye transfer inhibitors without affecting the resulting product color or performance properties. Where flourescent whiteners are used, they are premixed with the actives and triethanolamine and heated to 160° F. prior to adding to the water mixture.

Performance Testing

The extent of dye transfer from a colored fabric onto a white fabrics was assessed by CIE Color measurement. The CIE color system evaluates the color of a fabric sample in terms of the L*,a*,b* coordinates which are determined from spectrophotometer readings. (L*,a*,b* are as described in Colorimetry, 2nd Edition, CIE Publication no. 15.2, published by the Bureau, Central de la CIE, Paris, 1986) The DELTA (E) value is defined by the following equation:

$$\text{Delta } E=\{(L^*_f-L^*_i)^2+(a^*_f-a^*_i)^2+(b^*_f-b^*_i)^2\}^{1/2}$$

where the subscripts i and f refer to the value as measured before and after washing in the presence of the bleeding fabric, respectively. DELTA E values of about 0.8 and greater were found to be visually perceivable.

100% white cotton cloths dyed with Direct Red 80 (bleeding cloths) and undyed white 100% sample cotton cloths were washed together with a commercial detergent at a washing temperature 120° F.; rinsing temperature 70° F. as described below.

Sample A was washed with the fabric softener composition of example 1.

Sample B was washed with the fabric softener composition of example 4 which did not contain a dye transfer inhibitor.

Sample C was washed with no fabric softener used in the rinse.

The cloths were assessed according to the CIE color measurements with the following results:

DELTA E values for the cotton monitor cloths

| Sample | Delta E Values |
|---|---|
| Sample A | 23.61 |
| Sample B | 25.92 |
| Sample C | 26.78 |

It was thus observed that an enhanced dye transfer inhibiting performance was provided by the combination of the cationic surfactant with polyvinyl pyrrolidone.

Fabric Staining Testing

The following tests show the low staining properties of the compositions of the invention.

Direct Staining Test Procedure

Apparatus and Materials 250 ml beaker glass stirring rod 5.75'×5.75' swatches of Terry cloth 63/35 Dacron/permanent press diaper (100% 0 cotton Birdseye type)

Lycra

Silk

Wool

65/35 Dacron/cotton

Acetate

Spun Dacron

Spun Nylon

Spun Orlon

Spun Viscose

Banlon

Wool flannel

Texturized polyester twill polyester

Polyester double knit

½ teaspoon measure

KENMORE washing machine-Model 70 or equivalent

Detergent

Medicine dropper

Procedure

Fabric swatches were washed in 100° F. water with detergent. At the completion of the wash, the machine was allowed to spin only long enough to remove excess wash solution. The cloths were not spray rinsed or rinsed in any way. All clothes were removed from the washing machine and dried in a static dryer. After drying, 20 drops of fabric conditioner were applied directly to the cloths and the cloths were folded with pressure in order to obtain a 2 inch circle. The stained cloths were allowed to age about 24 hours, then put through a rinse cycle only, in a KENMORE washing machine. (no additional softener was added). The cloths were dried again. The cloths were visually evaluated under simulated northern daylight and rated for residual staining according to the following system:

0-no staining 2-trace 4-slight 6-moderate 8-considerable.

The scores obtained for each cloth were then added to obtain a total staining score. The test was repeated for each fabric conditioning composition tested. The lower the total staining score, the less staining occurred in the fabric.

Test 1

This test compared the use of the preferred colorant described in this invention with and without the use of a dye transfer inhibitor. Included in this test is a leading commercially available fabric softener.

| Composition | Total staining score |
|---|---|
| Commercially available fabric softener | 76 |
| Example 5 | 42 |
| Example 5 without dye transfer inhibitor | 42 |

The results show the example 5 formula (both with and without dye transfer inhibitor) to be better than the commercial product and that use of the dye transfer inhibitor did not increase the fabric staining when used with a preferred colorant described in this invention.

Test 2

This test compared the use of preferred colorants described in this invention with use of a dye transfer inhibitor

| Composition | Total staining score |
|---|---|
| Commercially available fabric softener | 76 |
| Example 1 | 60 |
| Example 6 | 32 |
| Example 7 | 38 |

The results obtained from testing further examples of the preferred colorants used in this invention with dye transfer inhibitors, were found to be better than the commercially available product for reducing staining potential.

We claim:

1. A colored concentrated aqueous fabric conditioning composition comprising:

a) from about 3% to about 35% by weight of a fabric conditioning agent;

b) from about 0.0001% (1 ppm) to about 0.05% (500 ppm) by weight of a colorant selected from the group consisting of dyestuffs consisting of Acid Blue 80, FD&C Blue 1, Acid Yellow 17, Acid Yellow 23, FD&C Green 3, FD&C Red 4, Acid Red #52 and mixtures thereof; and c) from about 0.1% to about 10% of a dye transfer inhibiting compound.

2. A composition according to claim 1 wherein the dye transfer inhibiting compound is selected from the group consisting of polyvinyl pyrrolidone, polyvinyl imidazole, a copolymer of N-vinylimidazole N-vinylpyrrolidone, poly amine N oxide polymers and mixtures thereof.

3. A composition according to claim 1 wherein the dye transfer inhibiting compound is selected from the group consisting of polyvinyl pyrrolidone, polyvinyl imidazole, a copolymer of N-vinylimidazole N-vinylpyrrolidone, and mixtures thereof.

4. A composition according to claim 1 wherein the dye inhibiting transfer compound is polyvinyl pyrrolidone.

5. A composition according to claim 4 wherein the polyvinyl pyrrolidone has an average molecular weight of from about 1,000 to about 100,000.

6. A composition according to claim 1 wherein the fabric conditioning agent is a compound selected from the group consisting of:

a)

I

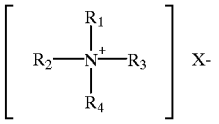

wherein $R_1$ is selected from $C_1$ to $C_{20}$ alkyl and alkenyl groups, and $R_2$ is selected from the group consisting of $C_{14}$ to $C_{20}$ alkyl and alkenyl groups and $R_3$ and $R_4$ are the same or different from each other and are selected from the group consisting of $C_1$ to $C_3$ alkyls, or $—(C_nH2_nO)_xH$ wherein n is 2 or 3, x is from 1 to about 3, and wherein X— is halide, $HSO_4$—, nitrate, methyl sulfate or ethylsulfate, b)

II

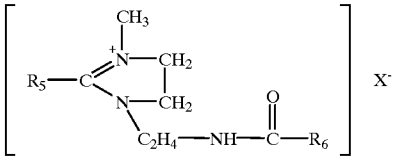

wherein $R_5$ and $R_6$ are the same or different from each other and are selected from the group consisting of $C_{14}$ to $C_{20}$ alkyl and alkenyl groups, wherein X— is as defined above, c)

III

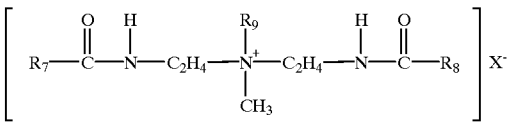

wherein $R_7$ and $R_8$ are the same or different from each other and are selected from the group consisting of $C_{14}$ to $C_{20}$ alkyl and alkenyl groups, wherein $R_9$ is selected from H, methyl, ethyl and $—(C_nH2_nO)_xH$ wherein n is 2 or 3 and x is from 1 to about 5, and wherein X— is as defined above d)

IV

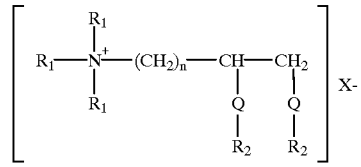

wherein each Q is —O—(O)C— or —C(O)—O; m=1 to 3; each n=an integer from 1 to 4, and mixtures thereof;

each $R_1$ is selected from the group consisting of: $C_1$–$C_6$ alkyl groups; $C_1$–$C_4$ hydroxy alkyl groups; benzyl; or mixtures thereof;

each $R_2$ is a long chain, saturated and/or unsaturated $C_8$–$C_{30}$ hydrocarbyl, or substituted hydrocarbyl substituent or mixtures thereof; and the counterion, X—, is as defined above; and e)

$$(R_1)_{4-m}—N^+[(CH_2)_n—Q—R_2]_m\ X— \quad (V)$$

wherein

Q is —O—(O)C— or —C(O)—O; m=1 to 3; each n=an integer from 1 to 4, and mixtures thereof;

each $R_1$ is selected from the group consisting of $C_1$–$C_6$ alkyl groups; $C_1$–$C_4$ hydroxy alkyl groups; benzyl; or mixtures thereof;

$R_2$ is a long chain, saturated and/or unsaturated $C_8$–$C_{30}$ hydrocarbyl, or substituted hydrocarbyl substituent or mixtures thereof; and the counterion, X—, is as defined above and mixtures thereof.

7. A composition according to claim 6 wherein the fabric conditioning agent is a mixture comprising a compound of formula I and a compound of formula Ill.

8. A composition according to claim 6 wherein the compound of formula V is methyl, hydroxy ethyl diethyl ester ammonium methyl sulfate.

9. A composition according to claim 6 wherein the fabric conditioning compound of formula V is diethyl ester dimethyl ammonium chloride.

10. A composition according to claim 1 further comprising up to 2.0% by weight of one or more additives selected from the group consisting of cellulase or lipase enzymes, silicone emulsions, hydrocarbon oil emulsions, preservatives, optical brighteners, buffers, opacifiers, germicides, UV absorbers and anti-oxidants, soil release agents, anti-wrinkle agents, bactericides and mixtures thereof.

11. A composition according to claim 1 which further comprises an effective amount of a fluorescent whitener to enhance whiteness.

12. A composition according to claim 11 wherein the fluorescent whitener derived from stilbene sulfonic acid.

13. A method of inhibiting dye transfer in fabrics comprising:

a) preparing a colored concentrated aqueous fabric conditioning composition comprising:

i) from about 3% to about 35% by weight of a fabric conditioning agent selected from the group consisting of a cationic softening active, a nonionic softening active and mixtures thereof, ii) from about 0.0001% (1 ppm) to about 0.05% by (500 ppm) by weight of a colorant selected from the group consisting of dyestuffs and pigments that exhibit a low degree of fabric staining when used in a rinse cycle product and, iii) from about 0.1% to about 10% of a dye transfer inhibiting compound, and iv) water; and b) introducing the composition into a rinsing cycle to condition and prevent dye transfer of fabrics.

14. A colored concentrated aqueous fabric conditioning composition comprising:

a) from about 12 to about 20 wt. % of an ethoxylated methyl ammonium methylsulfate;

b) from about 3 to about 8 wt. % of dihydrogenated tallow dimethylammonium chloride;

c) from about 0.1 to about 10.0 wt. % of polyvinyl pyrrolidone;

d) from about 0.05 to about 0.5 wt. % of lactic acid;

e) from about 0.05 to about 0.4 wt. % calcium chloride;

f) from about 0.02 to about 0.10 of glutaraldehyde;

g) from about 0.2 to about 1.0 wt % of a perfume;

h) from about 0.0001 to about 0.05 wt. % of at least one dye selected from the group consisting of Acid Blue 80, FD&C Blue 1, Acid Yellow 17, Acid Yellow 23, FD&C Green 3, FD&C Red 4, Acid Red #52 and mixtures thereof; and i) water in an amount to bring to the total composition to 100 wt. %.

15. A fabric conditioning composition according to claim 14, wherein the at least one dye is Acid Blue 80.

16. A fabric conditioning composition according to claim 14, wherein the at least one dye is Acid Yellow 17 Dye.

17. A fabric conditioning composition according to claim 14 wherein the at least one dye is FD&C Green #3.

18. A method of preparing a colored concentrated fabric conditioning composition comprising the steps of:

a) introducing into a solution of water and colorant about 3% to about 35% by wt. of a molten fabric conditioning agent;

b) subsequently adding into the solution of step a) a salt solution under controlled shear and in a series of distinct sequential addition; and c) subsequently adding from about 0.1% to about 10 wt. % of a dye transfer inhibiting compound as a solution in deionized water to form a homogeneous fabric conditioning composition having an average diameter size of about 2 to about 8 microns.

* * * * *